US012098873B1

(12) United States Patent
Barker et al.

(10) Patent No.: US 12,098,873 B1
(45) Date of Patent: Sep. 24, 2024

(54) CRYOGENIC CELL

(71) Applicants: Donald Wade Barker, Gallatin, TN (US); Andrew McAleavey, Reno, NV (US)

(72) Inventors: Donald Wade Barker, Gallatin, TN (US); Andrew McAleavey, Reno, NV (US)

( * ) Notice: Subject to any disclaimer, the term of this patent is extended or adjusted under 35 U.S.C. 154(b) by 0 days.

(21) Appl. No.: 18/733,742

(22) Filed: Jun. 4, 2024

(51) Int. Cl.
*F25B 9/14* (2006.01)
*F25B 31/00* (2006.01)

(52) U.S. Cl.
CPC ..... *F25B 9/14* (2013.01); *F25B 31/00* (2013.01)

(58) Field of Classification Search
CPC ..... F25B 9/14; F25B 31/00
See application file for complete search history.

(56) References Cited

U.S. PATENT DOCUMENTS 11,448,459 B1 * 9/2022 Barker ..... F25J 3/066
2023/0021519 A1 * 1/2023 Barker ..... B01D 53/002

FOREIGN PATENT DOCUMENTS

WO 2023/004433 A1 1/2023

* cited by examiner

*Primary Examiner* — Emmanuel E Duke
(74) *Attorney, Agent, or Firm* — Andrew McAleavey

(57) ABSTRACT

A cryogenic cell adapted to expose a fluid to selectable pressure and temperature conditions has a core filled with a cryogen and a space in selective, partial thermal communication with the core, the space being at least substantially airtight and adapted to be filled or evacuated with a compressible fluid that (1) increases or decreases thermal communication with the core in accordance with a pressure of the compressible fluid within the space, and (2) places contents of the space under the pressure of the compressible fluid. As heat exchange between the core and the space occurs, cryogen vapor is withdrawn from the core, compressed into liquid, and returned to the core. The core does not include a cold head.

21 Claims, 11 Drawing Sheets

CRYOGENIC CELL

TECHNICAL FIELD

The invention relates, in general, to cryogenic technology, and more particularly, to a cryogenic cell with an integrated cold head.

BACKGROUND

U.S. Pat. No. 11,448,459 discloses a cryogenic cell, a device that can bring a space to essentially any conditions of temperature and pressure, down to cryogenic temperatures and up to relatively high pressures. In a cryogenic cell, a central core is filled with a cryogen, such as liquid nitrogen. The central core is in selective thermal communication with a pressurizable space. The pressurizable space can be pressurized with a fluid, such as a gas, up to pressures of, e.g., about 750 psi. By heat exchange with the core, the pressurizable space can be cooled to a temperature at or near the temperature of the cryogen within the core. The rate of heat exchange with the core is dependent, at least in part, on the pressure within the pressurizable space.

As heat exchange between the core and the pressurizable space occurs, the cryogen within the core vaporizes. To regenerate the cryogen into liquid phase and allow the core to continue cooling the pressurizable space, the core includes a commercial cold head filled with a colder cryogen, such as liquid helium.

Cryogenic cells have a number of applications. U.S. Pat. No. 11,448,459 describes a gas separation and purification system that uses cryogenic cells. In the disclosed system, mixed-gas streams are fed into the pressurizable space of a cryogenic cell or a number of such cells. The pressurizable space is set to conditions of temperature and pressure that cause at least one gas of the mixed-gas stream to undergo a phase change, after which it can be separated from the stream. As another example, international publication WO2023/004433 proposes the use of cryogenic cells in atmospheric water harvesting.

BRIEF SUMMARY

The present inventor has found that the use of a cold head to regenerate the cryogen within a cryogenic cell puts meaningful, and often unwanted, limitations on the size, features, and function of cryogenic cell. For example, the cold head has specific dimensions, thus imposing certain minimum dimensions on the cryogenic cell as a whole. Additionally, conventional cold heads usually have a limited volume of cryogen within them. This can limit the rate at which the cold head and the core can absorb heat and, consequently, the volume of fluid that can be processed by a cryogenic cell in a given period of time. Such limitations are particularly a problem with, e.g., gas separation applications in which it is desirable to process large volumes of gas in a short period of time.

One aspect of the invention relates to a cryogenic cell. The cryogenic cell includes a core adapted to contain a cryogen. The core has one or more ports to an outside of the cryogenic cell that allow the cryogen to circulate into and out of the core. A mid-wall is disposed around the core and is spaced from the core. The mid-wall defines, in part, a space in selective, partial thermal communication with the core. The space is at least substantially airtight and is adapted to be evacuated or filled with a compressible fluid that (1) increases or decreases thermal communication with the core in accordance with a pressure of the compressible fluid within the space, and (2) places contents of the space under the pressure of the compressible fluid. A conduit is positioned within the space such that the conduit does not make physical contact with the core. The conduit is connected with inlet and outlet ports in the cryogenic cell. The cryogenic cell does not include a cold head within the core.

To prevent heat loss, the cryogenic cell also typically includes an outer sidewall, a top, and a bottom, each made of a thermally insulative material. The thermally insulative material of the top and bottom may be different than the thermally insulative material of the outer sidewall. The conduit may comprise a set a set of coils arranged around the core. The space may include at least one pressurization port that communicates with the outside of the cryogenic cell. The one or more ports in the core may comprise a cryogen inlet port and a cryogen outlet port.

Another aspect of the invention relates to a system. The system comprises a cryogenic cell as described above and a cryogenic compressor. The cryogenic compressor is connected to the cryogen inlet port and the cryogen outlet port of the cryogenic cell, and is arranged and adapted to remove cryogen vapor resulting from heat exchange between the core and the space from the core through the cryogen outlet port, compress the cryogen vapor into liquid cryogen, and return the liquid cryogen to the core through the cryogen inlet port.

In this system, there may be multiple cryogenic compressors, arranged either in series or in parallel with one another. If arranged in series, bypasses may be installed so that one compressor can be used at a time. Series-connected cryogenic compressors may be the same or different. If different, the cryogenic vapor may be subjected to a multiple-stage compression.

Yet another aspect of the invention also relates to a system. The system comprises a manifold, a cryogenic cell as described above, and two or more cryogenic compressors. The cryogenic cell and the cryogenic compressors are placed in selective communication with one another through the manifold to remove cryogen vapor resulting from heat exchange between the core and the space from the core through the cryogen outlet port, compress the cryogen vapor into liquid cryogen, and return the liquid cryogen to the core through the cryogen inlet port.

In this system, there may be a plurality of cryogenic cells and a plurality of compressors. The system may also comprise a controller. The controller controls the manifold to independently control the rate at which the cryogen is removed from, compressed, and returned to the cores of the plurality of cryogenic cells in accordance with the thermal load on each of the plurality of cryogenic cells.

Other aspects, features, and advantages of the embodiments of the invention will be set forth in the following description.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
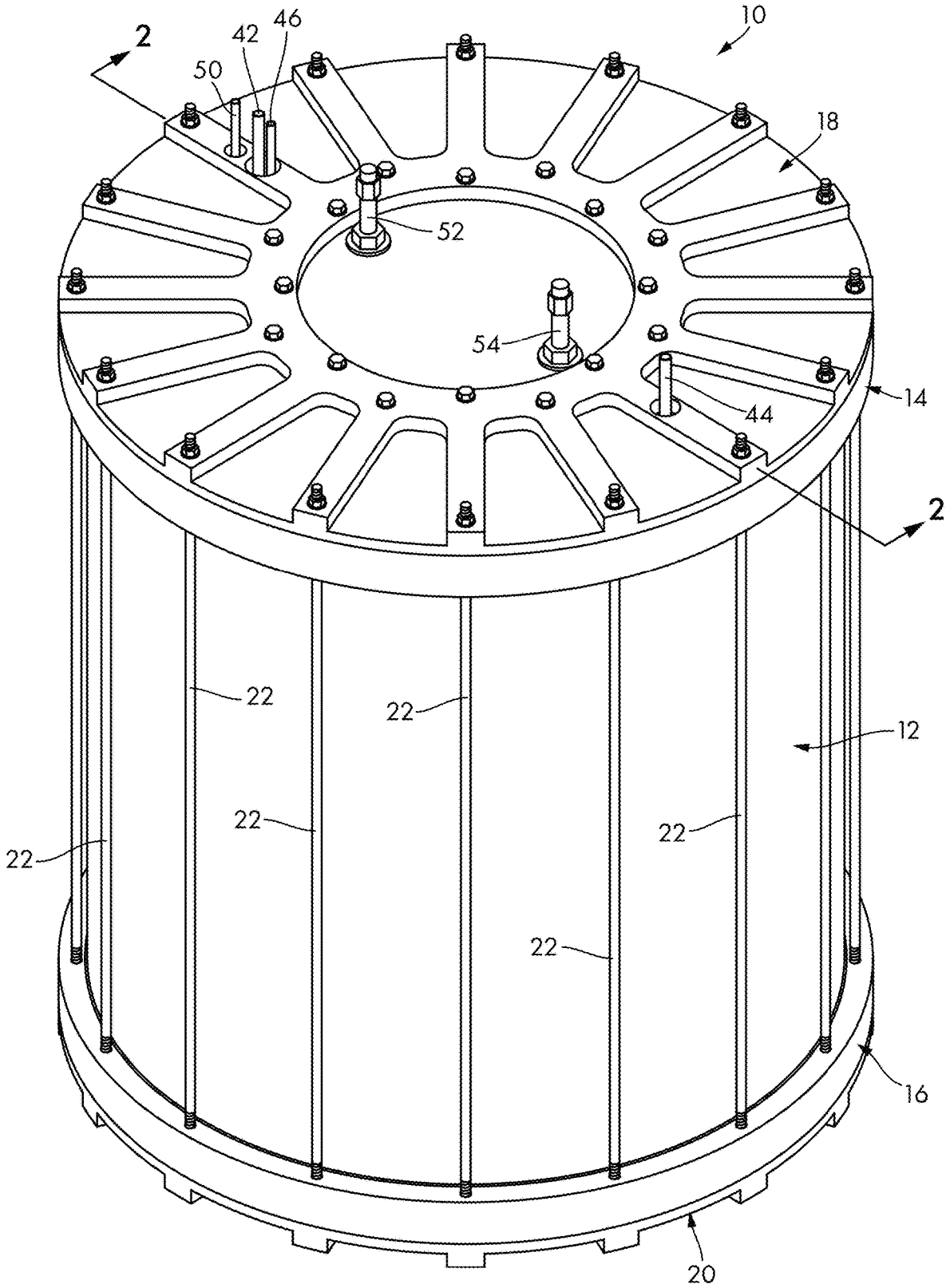
FIG. 1 is a perspective view of a cryogenic cell according to one embodiment of the invention.

FIG. 1 is a perspective view of a cryogenic cell, generally indicated at 10, according to an embodiment of the invention. The cryogenic cell 10 of FIG. 1 is generally cylindrical in overall shape, with a cylindrical sidewall 12, a top 14, and a bottom 16. The top 14 and the bottom 16 are reinforced with reinforcing plates 18, 20, which will be discussed in greater detail below. As can be seen in FIG. 1, the cryogenic cell 10 is reinforced and held together along its longitudinal axis by a number of tie rods 22, which extend from, and are received in, the top 14 to the bottom 16, and are bolted in place.

As used here, the term "longitudinal axis" refers to an axis aligned with the centers of the top 14 and the bottom 16 and extending between the top 14 and the bottom 16. The term "longitudinal direction" refers to a direction parallel to or along the longitudinal axis. The terms "radial direction" and "radially" refer to a direction that extends between the longitudinal axis and the sidewall 12.

In the cryogenic cell 10, the exterior sidewall 12, top 14, and bottom 16 primarily offer thermal insulation. To that end, it is helpful if the materials of which these components 12, 14, 16 are made have thermal insulating properties, can withstand cryogenic temperatures without shattering, and are machinable, moldable, castable, or otherwise workable. Ultra-high molecular weight (UHMW) polyethylene is one such material and, e.g., the top 14 and the bottom 16 may be made of UHMW polyethylene. However, the cryogenic cell 10 and its components 12, 14, 16 need not be made, or made entirely, of expensive or exotic materials. For example, the sidewall 12 may be made of high-density polyethylene (HDPE), e.g., HDPE pipe. A wall thickness of about 2-3 inches (5-7.6 cm) may be appropriate in at least some embodiments. In one embodiment, the sidewall 12 may be an HDPE pipe with an outer diameter of 34 inches (86.4 cm) and an inner diameter of 31 inches (78.7 cm).

Figure 2:
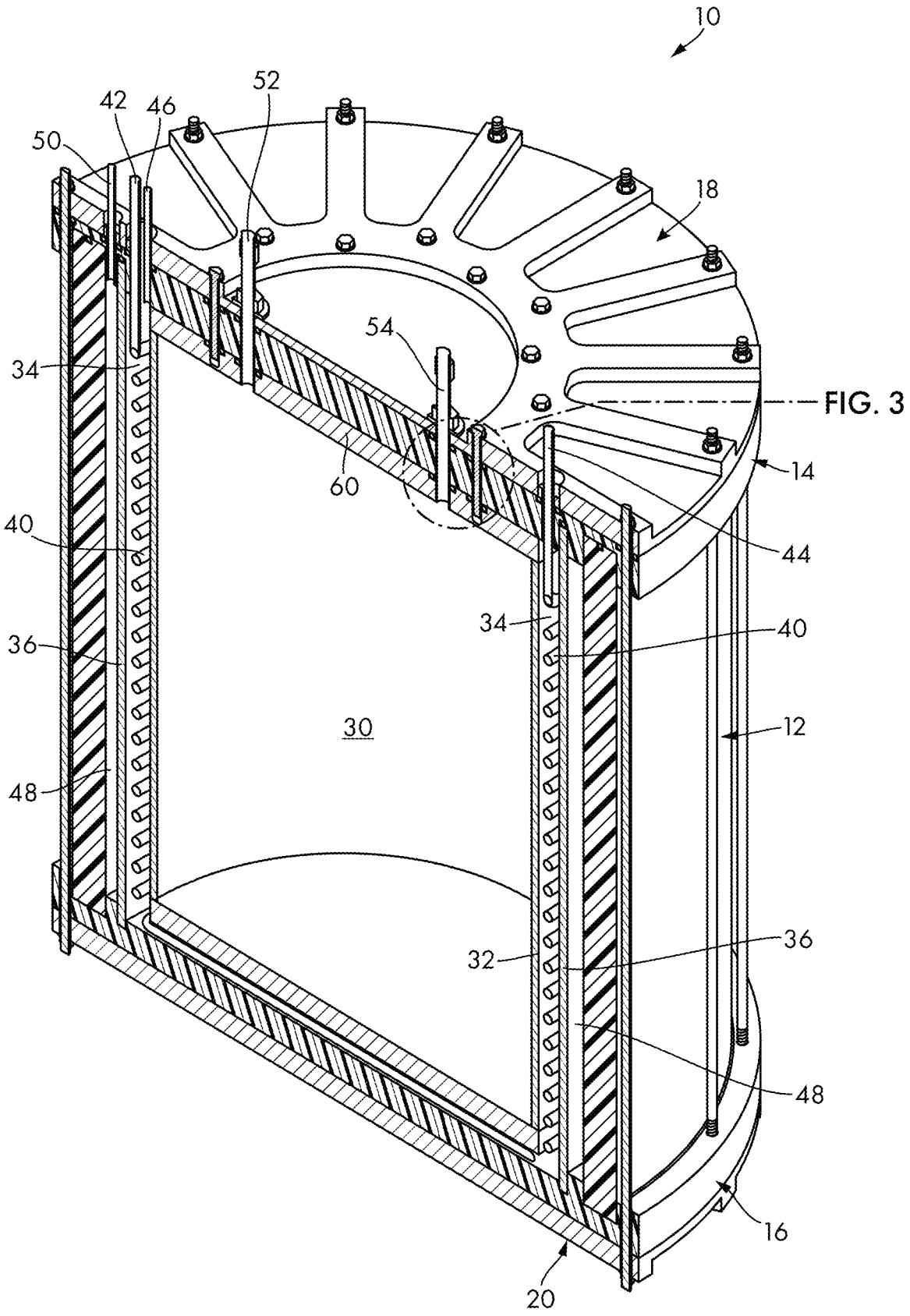
FIG. 2 is a cross-sectional perspective view taken through Line 2-2 of FIG. 1.

FIG. 2 is a cross-sectional view of the cryogenic cell 10, taken through Line 2-2 of FIG. 1. The cryogenic cell 10 has a core 30, which is centered about the longitudinal axis. The core 30 is a vessel with at least a sidewall 32 that is made of a thermally-conductive material. In the illustrated embodiment, the entire core 30 is made of 6061 T6 aluminum, although other materials, like copper, may be used depending on the pressures at which the cryogenic cell 10 is to operate.

A pressurizable space 34 is defined between the sidewall 32 of the core 30 and a mid-wall 36 that is positioned radially outward of the sidewall 32 of the core 30. The mid-wall 36 extends between the top 14 and the bottom 16, fully separating the pressurizable space 34 from other compartments and portions of the cryogenic cell 10. The sidewall 12 is positioned radially outward of the mid-wall 36, with a gap between the mid-wall 36 and the sidewall 12.

A set of tubing 40 runs within the pressurizable space 34, generally coiled around the core 30. However, the set of tubing 40 is not in direct physical contact with the sidewall 32 or any other portion of the core 30. If spacers or other such structures are needed to maintain the position of the tubing 40, those spacers would generally not be thermally conductive. The set of tubing 40 is continuous between an inlet port 42 and an outlet port 44, both of which connect to the set of tubing 40 and penetrate the top 14. A length of the tubing 40 passes under the core 30 and is shown longitudinally sectioned in FIG. 2. The set of tubing 40 is but one example of the kind of conduit that may be present in the pressurizable space 34. In some embodiments, conduit may be used that does not coil around the core 30, is not round, or is otherwise adapted for a particular application.

At least one additional port 46 is used to charge the pressurizable space 34 and, when necessary, to remove pressure. For example, air or nitrogen gas may be pumped into the pressurizable space 34 to create a pressure. Additionally, the space 48 between the mid-wall 36 and the outer sidewall 12 may include a port 50 that, among other things, allows the space 48 to be evacuated for better thermal insulation, if needed.

The core 30 also includes a number of ports. More specifically, the core includes cryogen inlet and outlet ports 52, 54. The purpose of these ports will be explained in more detail below. Although there are only two ports 52, 54 that penetrate into the core 30, various connectors may be used to provide for additional connections, or to provide additional functionality.

Figure 3:
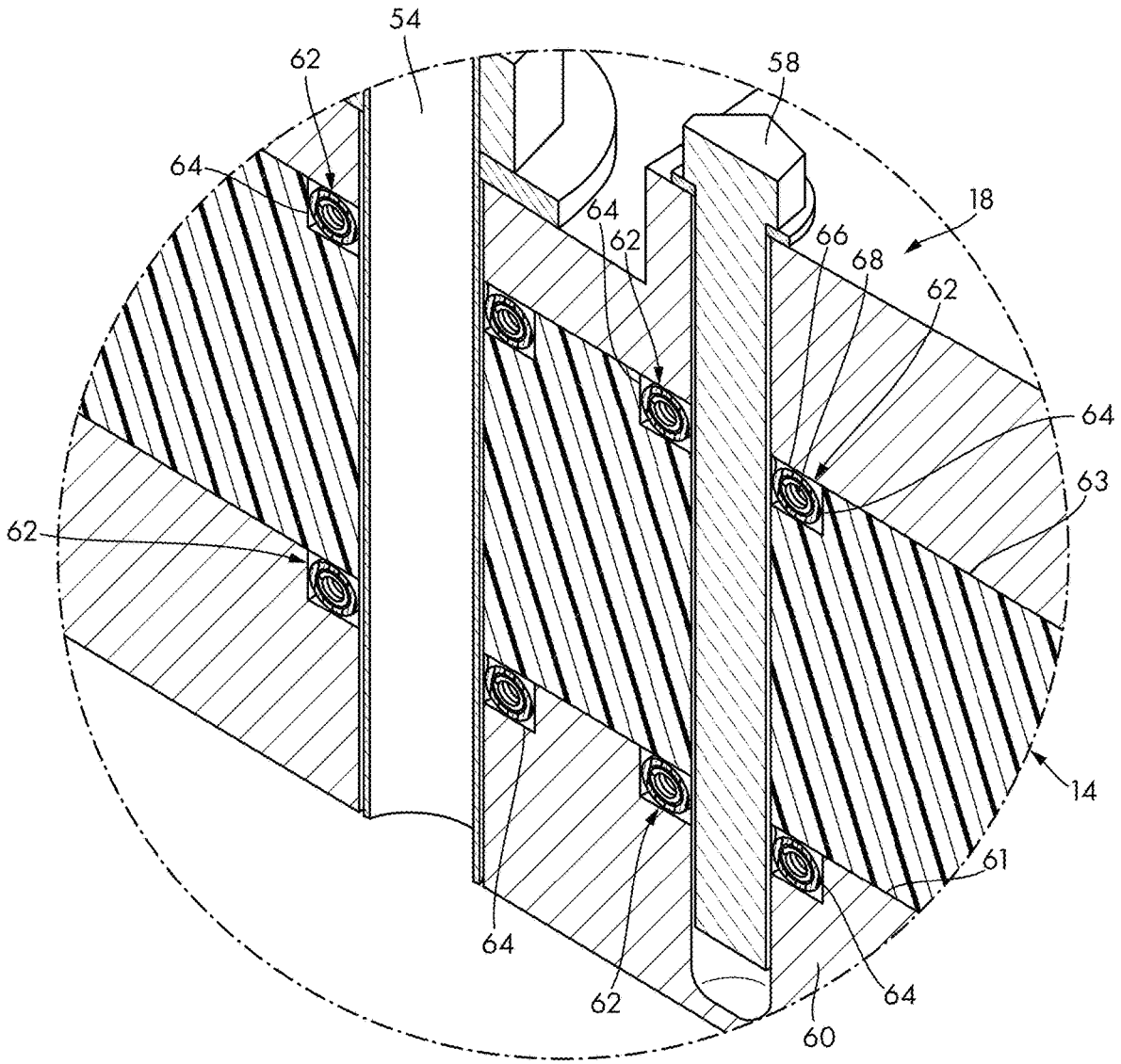
FIG. 3 is an enlarged cross-sectional perspective view of a portion of FIG. 2.

FIG. 3 is an enlarged view of a portion of FIG. 2, showing a bolt 58 and one of the ports 54 in the core 30. The bolt 58 inserts through the plate 18 and the top 16, terminating in the lid 60 of the core 30. The port 54 inserts through all three layers 18, 16, 60 and opens into the core 30 itself. To prevent leaks around the penetrations, circular O-ring grooves 64 are cut in the upper face 61 of the lid 60 of the core 30 and in the upper face 63 of the top 14 around the positions of each penetration. O-rings 62 are installed in those grooves 64.

In some applications, the O-rings 62 might be made of a conventional elastomer. However, it has been found that when conventional elastomeric O-rings are exposed to cryogenic temperatures, they lose all elasticity and shatter. Therefore, the O-rings 62 of the illustrated embodiment are made of a composite of materials. More specifically, an outer tube of polymeric material 66 is backed by an inner coil 68 of metal wire, such as a helix or double helix of 316 stainless steel wire. The outer tube of polymeric material 66 may be, e.g., perfluoroalkoxy (PFA) plastic.

As those of skill in the art will appreciate, heat transfer occurs by conduction, convection, and radiation. By adding gas to the pressurizable space 34 through the port 46, one increases the amount of mass in the space 34, and thus, the level of heat transfer that can occur by conduction and convection. By withdrawing gas from the pressurizable space 34 (or drawing a vacuum on the pressurizable space 34), one reduces the amount of mass in the space 34, and thus, the ability of heat to flow between the core 30 and the pressurizable space 34 by conduction and convection.

Thus, the pressurizable space 34 can be placed under essentially any conditions of temperature and pressure: as pressure is increased within the pressurizable space 34, conduction and convection increase, and thus, the rate of heat exchange with the core 30 also increases, making the pressurizable space 34 both colder and higher-pressure. When pressure within the pressurizable space 34 is lessened, the rate of heat transfer with the core 30 decreases. This has a number of potential uses, some of which will be described below.

As the core 30 experiences heat transfer with the pressurizable space 34, the cryogen within the core 30 will heat up and begin to vaporize. As that occurs, the ability of the core 30 to absorb heat will gradually decline. In the cryogenic cell of U.S. Pat. No. 11,448,459, the cryogen within the core is regenerated into cold, liquid phase by a cold head filled with a colder cryogen (e.g., liquid helium if liquid nitrogen is the primary cryogen within the core).

Figure 4:
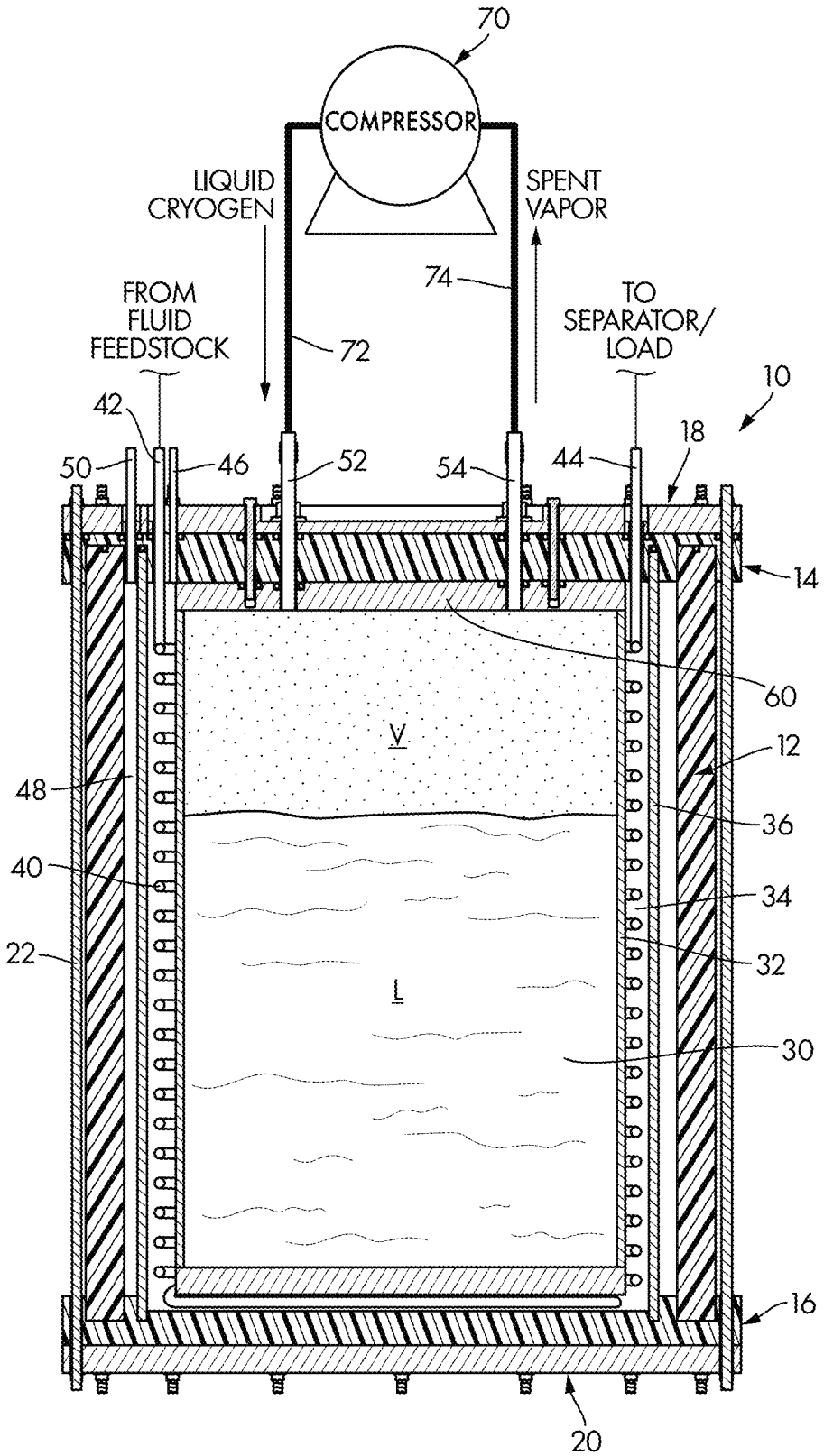
FIG. 4 is a cross-sectional view of the cryogenic cell taken through Line 2-2 of FIG. 1, shown with a cryogenic compressor and illustrating the manner in which cold cryogen within the core of the cryogenic cell is regenerated.

By contrast, the cryogenic cell 10 of the present embodiment, there is no cold head in the core 30, as can be seen in FIG. 4. FIG. 4 is a cross-sectional view of the cryogenic cell 10, again taken through Line 2-2 of FIG. 1. In the view of FIG. 4, two of the ports 52, 54 that connect to the core 30 are connected to a compressor 70. The compressor 70 may be specially adapted to compress cryogenic fluids. The compressor 70 may be, for example, a Sumitomo Cryogenics F-70 compressor.

In operation, the compressor 70 forms a closed circuit with the core 30 of the cryogenic cell 10. In that circuit, one of the ports 52 serves as an inlet port, through which the compressor 70 deposits liquid cryogen. The other port 54 serves as an outlet port, through which the compressor 70 removes vaporized cryogen.

During operation, because of heat transfer with the core 30, there will typically be both liquid-phase cryogen, labeled L in FIG. 4, and vapor-phase cryogen, labeled V in FIG. 4, in the core 30 at any one time. The rate of heat transfer with the core 30 will determine the rate at which the liquid cryogen L vaporizes. The capacity of the cryogenic cell 10 to cool the pressurizable space 34 (i.e., the heat transfer rate with the core 30 per unit time) will depend on the rate at which the compressor 70 can remove cryogenic vapor V, compress it back into liquid cryogen L, and return the liquid cryogen L to the core 30.

This arrangement—connecting the core 30 to a cryogenic compressor 70—removes the cold head found in prior cryogenic cell designs but retains its function; i.e., the cryogenic cell 10 can still regenerate the cryogen in its core 30. A cryogenic cell 10 without a cold head also has certain other advantages. For example, removing the cold head from the cryogenic cell 10 may, in many cases, have the effect of removing all moving parts from the cryogenic cell 10. This, in turn, may improve reliability and reduce the risk that fluids flowing through the set of tubing 40, which may be flammable, will come into contact with a spark.

Although the compressor 70 is illustrated as being relatively close to the cryogenic cell 10 in the view of FIG. 4, the cryogenic compressor 70 may be remote from the cryogenic cell 10, e.g., in the next room. So long as the supply 72 and return 74 lines can be kept properly insulated or otherwise arranged to minimize heat transfer with the surrounding environment, the cryogenic compressor 70 may be placed at any distance relative to the cryogenic cell 10.

The cryogen inlet and outlet ports 52, 54 are shown in the embodiment of FIGS. 1-4 as being separate physical structures that enter the cryogenic cell 10 and the core 30 at separate points. This may be the case in many embodiments. In other embodiments, inlet and outlet ports may enter the cryogenic cell 10 as part of a single, combined structure that penetrates the cryogenic cell 10 at a single location. From that single structure, separate inlet and outlet conduits may branch away from one another within the core 30.

As those of skill in the art will appreciate, in some applications, the cryogenic compressor 70 is an optional component. That is, there may be applications in which the amount of mass to be processed by the cryogenic cell 10 is small enough and the volume of the core 30 is large enough that it is not necessary to regenerate the cryogen vapor V that forms within the core 30 into liquid form. In that case, one would simply fill the core 30 and seal the port or ports 52, 54—and it may not be necessary to have or to use both ports 52, 54.

However, for perhaps the vast majority of applications, particularly those involving continuous flow through the pressurizable space 34, some form of regeneration using a cryogen compressor 70 will be used. Depending on the heat transfer requirements of the application, the cryogen compressor 70 may be used either intermittently or continuously.

As shown in FIG. 4, a single cryogenic cell 10 connected to a single cryogenic compressor 70 form a system. In that system, the cryogenic compressor 70 is a single point of failure; that is, if the cryogenic compressor 70 fails, the system as a whole fails. To prevent that from happening, it is possible to connect more than one compressor 70 to a single cryogenic cell 10.

Figure 5:
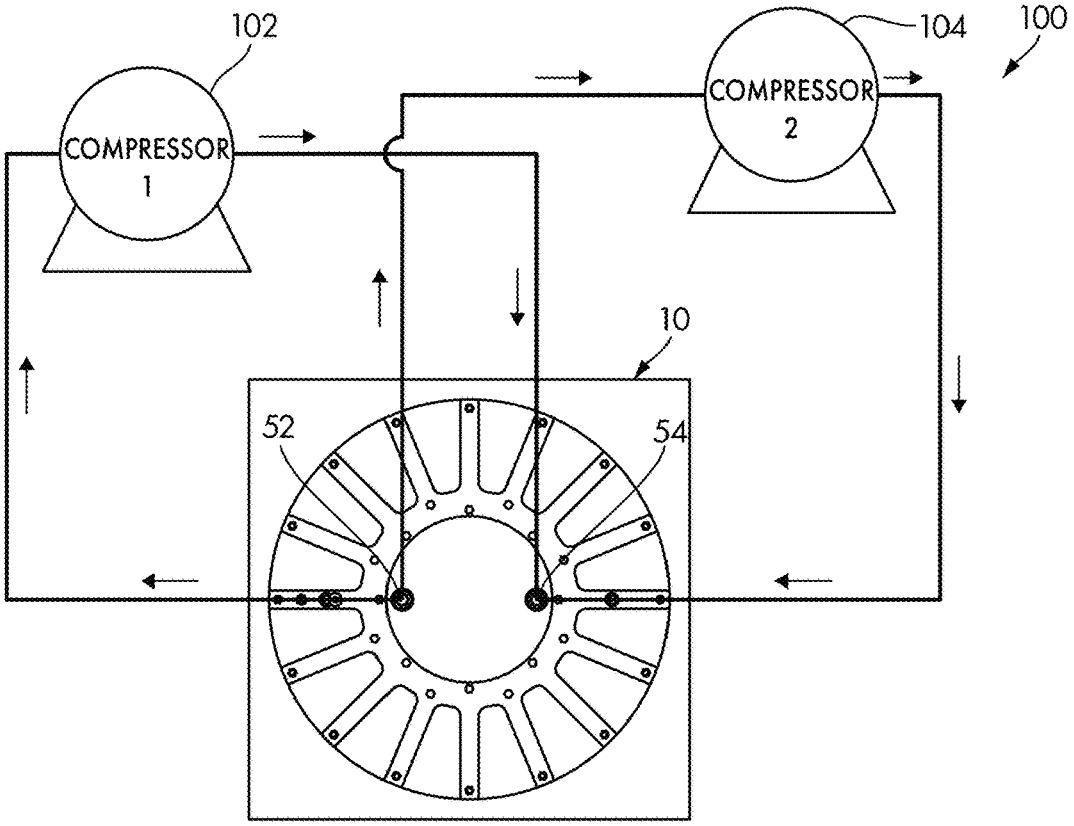
FIG. 5 is a schematic illustration of the use of two cryogenic compressors in parallel to serve a single cryogenic cell.

FIG. 5 is a schematic illustration of a system, generally indicated at 100, in which two compressors 102, 104 are connected to the same cryogenic cell 10. Each compressor 102, 104 is connected to the input and output ports 52, 54 of the cryogenic cell 10. In general, any number of compressors 70, 102, 104 may be connected to a cryogenic cell 10, and those compressors 70, 102, 104 may be arranged either in serial or in parallel. The arrangement of FIG. 5 is with the two compressors 102, 104 in parallel. With two compressors 102, 104 in parallel, should one compressor 102, 104 fail, the other compressor 102, 104 can be brought online to perform its function. However, the compressors 102, 104 need not be operated one-at-a-time. In some situations, it may be advantageous to use two or more compressors 102, 104 in parallel, as doing so may increase the volume of cryogen vapor V that can be compressed back into liquid form per unit of time. Variations on this are also possible: e.g., one cryogenic compressor 102, 104 can be engaged when the other cryogenic compressor 102, 104 reaches its functional limits, or the load can be balanced between the two cryogenic compressors 102, 104. If two cryogenic compressors 102, 104 are arranged in parallel and used simultaneously, they may be the same, i.e., have the same functional characteristics and specifications, or they may be different.

Figure 6:
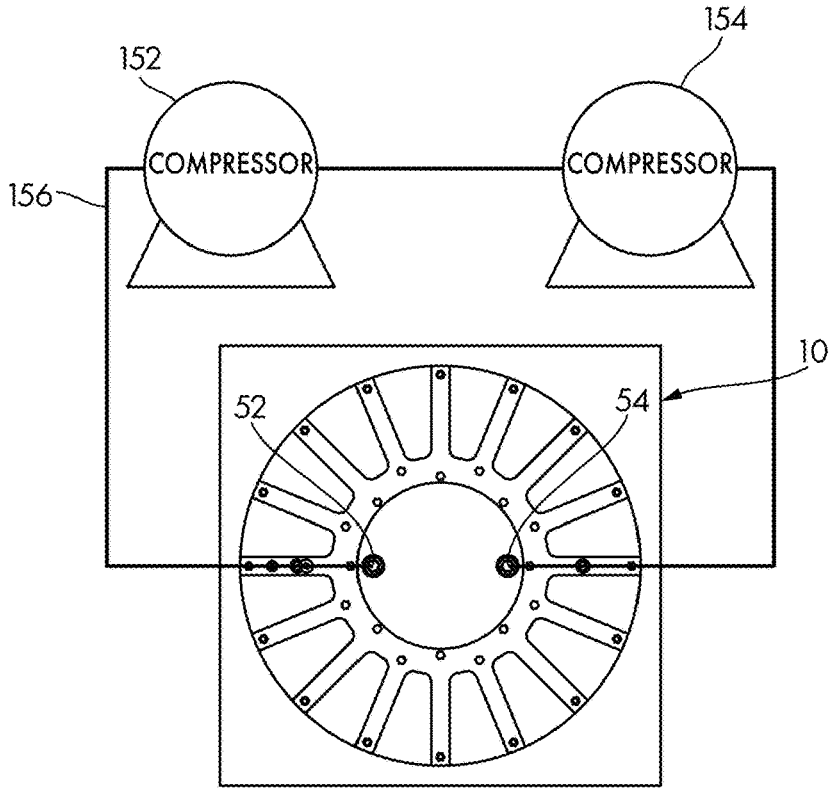
FIG. 6 is a schematic illustration of the use of two cryogenic compressors in series to serve a single cryogenic cell.

FIG. 6 is a schematic illustration of a system 150 in which two cryogenic compressors 152, 154 are used in series. If the two cryogenic compressors 152, 154 are the same, one compressor 152, 154 may be activated to take over for a failed compressor 152, 154. In that case, bypasses may be installed so that an inoperative compressor 152, 154 can be bypassed.

Figure 7:
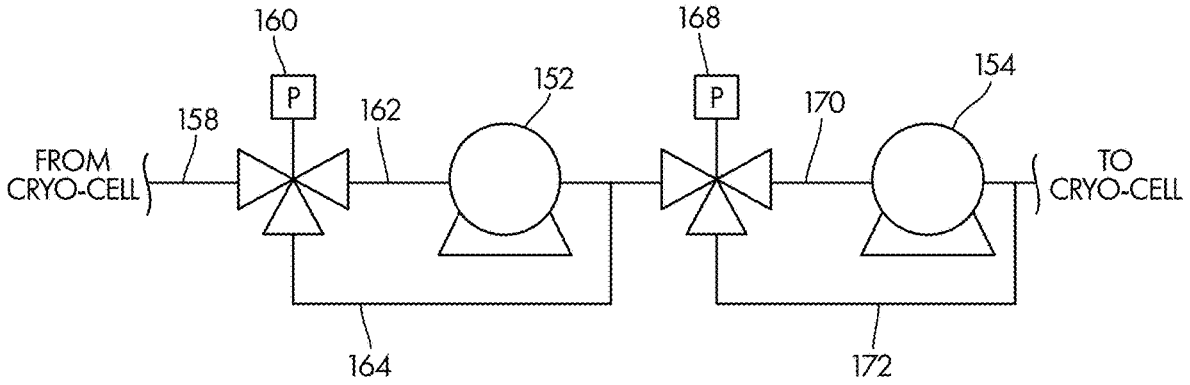
FIG. 7 is a schematic illustration of the use of bypasses in the configuration of FIG. 6 in order to allow only one of the two cryogenic compressors to function at a time.

FIG. 7 is an illustration of a variation on system 150 in which such bypasses are installed. More specifically, in FIG. 7, fluid flows through a first conduit 158 and encounters a first three-way valve 160. The first three-way valve 160 either allows the fluid to continue to flow through a conduit 162 toward the first compressor 152 or diverts the fluid flow through a first bypass loop 164 which avoids the first compressor 152 and directs the fluid flow through a conduit 166 toward the second compressor 154. Fluid in the conduit 166 encounters a second three-way valve 168 which either allows the fluid flow to continue through a conduit 170 toward the second compressor 154 or diverts the flow through a second bypass loop 172 which avoids the second compressor 154.

If the two compressors 152, 154 are not identical, various possibilities arise. For example, two compressors 152, 154 used in series could allow for a multi-stage compression process, where a first cryogenic compressor 152 compresses the incoming cryogen vapor V to particular conditions, and the second cryogenic compressor 154 completes the compression into liquid form.

Figure 8:
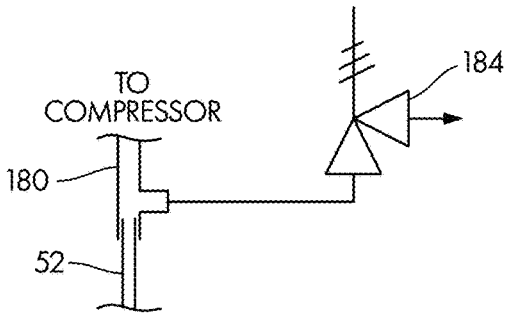
FIG. 8 is a schematic illustration of one of the ports connected to the core, illustrating the use of multiple connections to that port, and particularly showing a pressure relief valve connected to the port.

As was described above, although the cryogenic cells 10 described above have only two ports 52, 54 that penetrate into the core 30, those ports 52, 54 may be connected to various connectors to provide for additional connections and, in some cases, additional functionality. For example, in the schematic view of FIG. 8, one of the ports 52 is coupled to a T-connector 182, which is, in turn, connected to a pressure relief valve 182. If the compressor 70 fails, there is no backup compressor, and liquid cryogen L within the core 30 continues to vaporize, as the pressure within the core 30 mounts, there is the chance of failure of the vessel; that is, the cryogenic cell 10 could ultimately burst. The pressure relief valve 182 prevents this: if the pressure within the core 30 exceeds the limit of the pressure relief valve 182, the pressure relief valve 182 opens, releasing the excess pressure.

Figure 9:
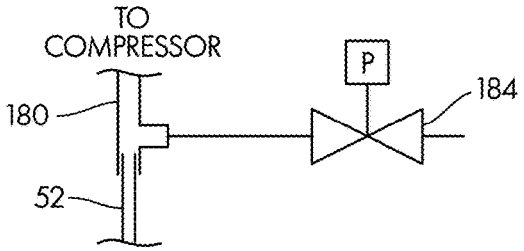
FIG. 9 is a schematic illustration similar to the view of FIG. 8, illustrating the connection of a pneumatic valve to the port.

In a variation on this, FIG. 9 shows an alternate configuration of this, in which the port 52 is connected to a T-connector 180, one outlet of which is connected to a pneumatically-actuated valve 184. Such a valve 184 would allow the compressor 70 to be bypassed and the contents of the core 30 to be either diverted or vented to atmosphere.

Figure 10:
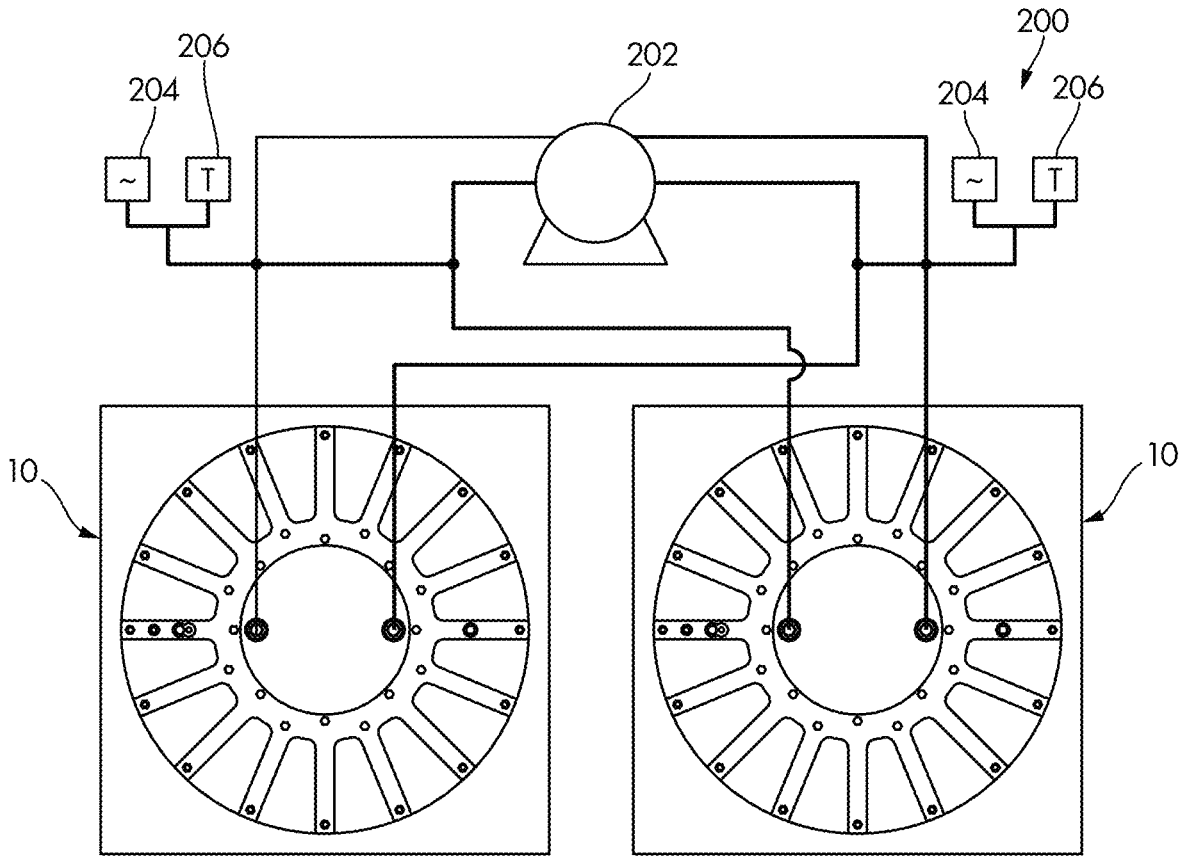
FIG. 10 is a schematic illustration of the use of one cryogenic compressor connected to two cryogenic cells.

Although the above focuses on multiple compressors being connected to a single cryogenic cell 10, the converse is also possible, i.e., one compressor may be connected to more than one cryogenic cell 10. FIG. 10 is an illustration of a system, generally indicated at 200, in which two cryogenic cells 10 are connected to a single compressor 202. In this system 200, depending on the particular arrangement, cryogen vapor V that is withdrawn from one cryogenic cell 10 may or may not be returned to the same cryogenic cell 10 as liquid cryogen L. In order to monitor the flow into and out of the cryogenic cells 10 and ensure that the core 30 of each cryogenic cell 10 is properly filled, system 200 has flow meters 204 in or coupled to the input and output lines. Temperature sensors 206, such as thermocouples, may also be included.

In system 200, the compressor 202 may serve both cryogenic cells 10 simultaneously, or the compressor 202 may serve the cryogenic cells 10 one at a time, switching back and forth between the cryogenic cells 10 to serve them. Various valves and fittings, which for the sake of simplicity are not shown in FIG. 10, may be used to isolate one cryogenic cell 10 or the other.

Systems like system 200 may not provide the redundancy of systems in which there are multiple cryogenic compressors 70, 102, 104, 152, 154, but where cost is a particular consideration, reliability is less of a concern, and the rate of heat exchange with the core 30 is not extreme, a system like system 200 may be ideal.

Figure 11:
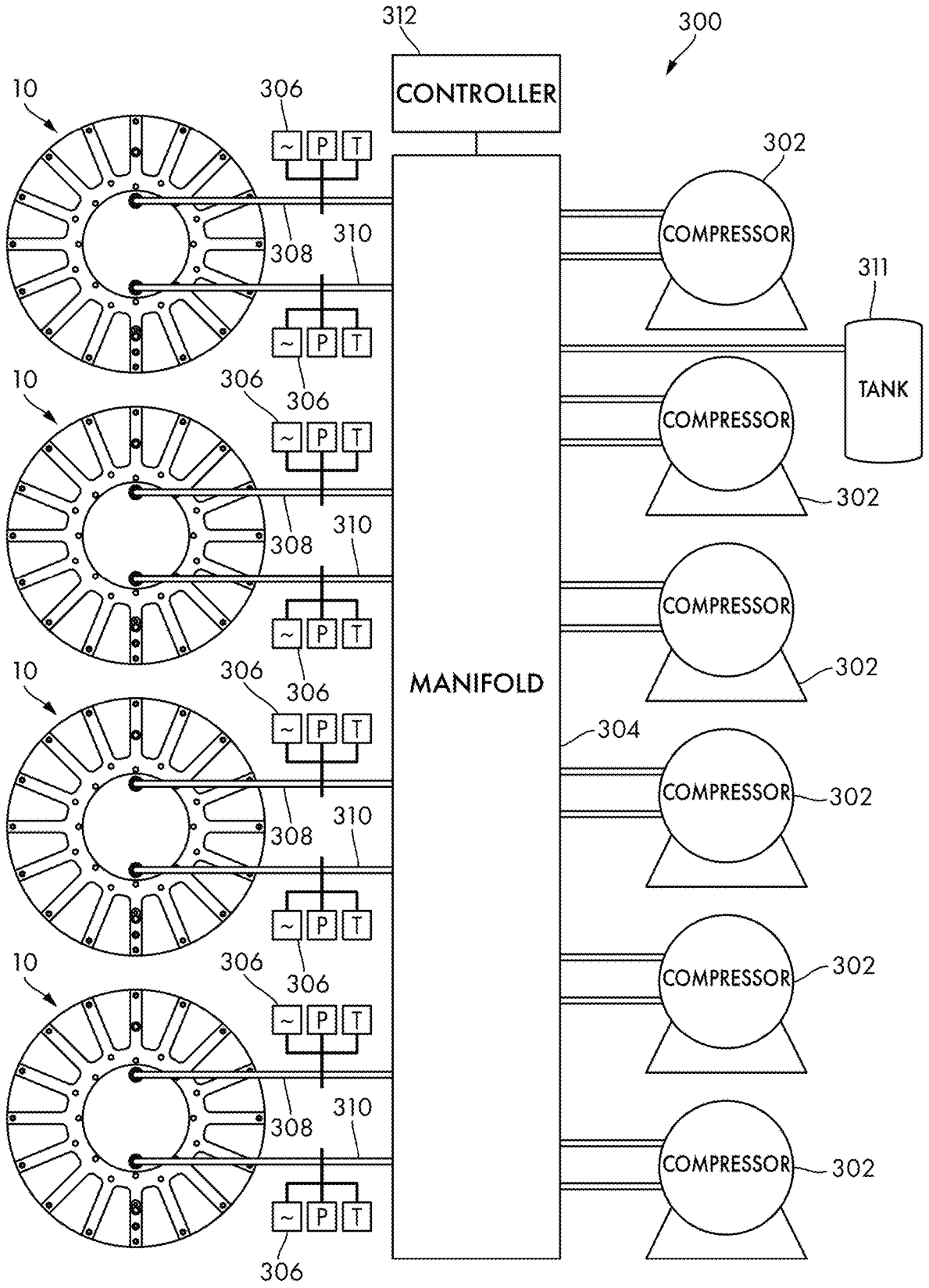
FIG. 11 is a schematic illustration of a system in which a plurality of cryogenic cells are connected to a plurality of compressors by way of a manifold.

In all of the description above, it is assumed that the connections between the cryogenic cell 10 and any cryogenic compressors 70, 102, 104, 152, 154 that are connected to it are individual connections made with various connectors. That may not always be the case. FIG. 11 is a schematic diagram of a system, generally indicated at 300, in which there are six cyrogenic compressors 302 serving four cryogenic cells 10 through a manifold 304.

As in system 200, with the manifold 304 of system 300, cryogenic vapor V removed from one cryogenic cell 10 will not always be redeposited as liquid cryogen L in the same cryogenic cell 10. Therefore, a sensor or sensor suite 306 monitors the inflow and outflow lines 308, 310 into and out of the cryogenic cells 10. The contents and particular sensors in the sensor suite 306 may vary from embodiment to embodiment, depending on how system 300 is controlled. Typically, the sensor suite 306 would include a flow sensor, to monitor the flow into and out of the core 30, and optionally, a temperature sensor. Additionally, the sensor suite 306 may be equipped with a pressure sensor in each of the lines 308, 310, or at least in the outflow line 310 of each cryogenic cell 10. Although FIG. 11 shows multiple sensor suites 306, one in each line 308, 310, in some cases, a single instrument that can receive and process multiple flows simultaneously may be used. The lines 308, 310 may be diverted through such an instrument, instead of extending directly between the cryogenic cells 10 and the manifold 304.

In some embodiments, a system like system 300 may optionally include, or be coupled to, a surge tank 311, which contains additional cryogen that can be introduced into system 300 in case of high demand, leaks, and other situations in which additional cryogen would be useful. In the illustrated embodiment, the surge tank 311 is connected to the manifold 304, but not directly to any of the cryogenic cells 10. A valve or valves (for simplicity, not shown in FIG. 11) may be placed to control flow into and out of the surge tank 311.

A controller 312, which may be a microprocessor, a microcontroller, an application-specific integrated circuit (ASIC), an integrated, embedded system including one of those components, or a programmable logic controller (PLC), controls the manifold 304 to control the flows of cryogen into and out of the cryogenic cells 10. Several general principles may guide the manner in which the controller 312 controls the manifold 304. For example, as may be apparent from the description above, ideally, the pressure of cryogen vapor V within the core is as low as possible. That is, ideally, as soon as cryogen vapor V is formed by heat exchange with the pressurizable space 34, that cryogen vapor V is removed and replaced by liquid cryogen L. If cryogen vapor V is forming rapidly within the core 30, it means that the cryogenic cell 10 is experiencing a heavy thermal load. As the amount of cryogen vapor V increases, the pressure within the core 30 increases, and the controller 312 should act to relieve that pressure. However, as cryogen flows into and out of the core 30 of each cryogenic cell 10, the controller 312 should maintain at least some threshold volume of liquid cryogen L in the core. That is, the compressors 302 and manifold 304 should maintain a dynamic equilibrium that keeps at least a threshold amount of liquid cryogen L in the core 30 of each cryogenic cell 10, as a core 30 that is completely drained will be unable to absorb any heat from the pressurizable space 34.

Figure 12:
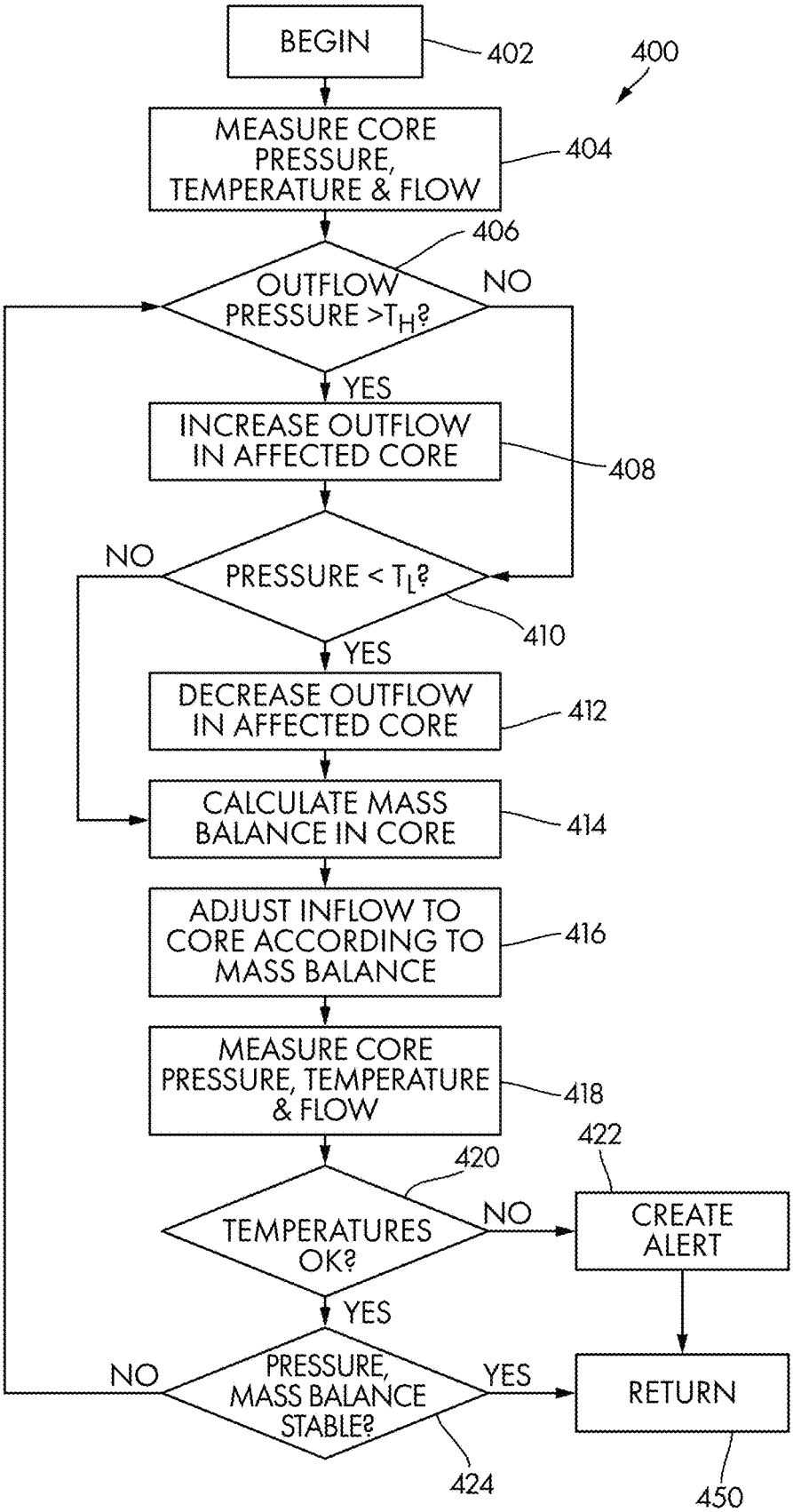
FIG. 12 is a schematic flow diagram of a method for controlling the system of FIG. 11.

FIG. 12 is a schematic flow diagram of a method, generally indicated at 400, for controlling a manifold-based system like system 300. Method 400 operates according to the general principles outlined above and begins at 402. For simplicity in explanation, method 400 will be set forth with reference to a single cryogenic cell 10 and its core 30. In task 404, the controller 312 measures the temperatures in the inflow and outflow lines 308, 310 of the core 30, as well as the pressures in the lines 308, 310, and the flow rates in the lines 308, 310. Additionally, prior to task 402, the controller 312 would typically be programmed with the initial volume or mass of cryogen in the cryogenic cell 10, as well as other operating parameters. Method 400 continues with task 406.

Task 406 is a decision task. In task 406, if the measured pressure in the outflow line 308 is higher than a predefined threshold TH (task 406: YES), that is an indication that heat transfer within the core 30 is high. Thus, method 400 continues with task 408. If the measured pressure in the outflow line 308 is not higher than the defined threshold (task 406: NO), method 400 continues with task 410.

In task 408, the controller 408 increases the outflow in the affected core 30, drawing more of the cryogen vapor V out of the core 30 to reduce the pressure in the core. Method 400 continues with task 410.

In task 410, the controller 312 checks whether the pressure in the core 30 is less than a defined threshold (TL). While it may be ideal to reduce the pressure in the core 30 to zero, such that there is only liquid cryogen L within the core 30. However, that may be a practical impossibility. Thus, the controller 312 is programmed with the defined low threshold TL. If the pressure in the core 30 reaches that threshold (task 410: YES), the controller 312 may slow the outflow rate in task 412 to divert necessary resources to other cryogenic cells 10.

Method 400 continues with task 414, and the controller 312 calculates the mass balance in the core 30 based on the detected flows. Tasks 406-412 of method 400 concern the rate at which cryogenic vapor V is removed from the core 30. In order to maintain mass balance within the core 30, liquid cryogen L must be added. Thus, based on the calculations in task 414, the controller 312 adjusts the inflow to the core 30 in task 416 to maintain mass balance, i.e., the appropriate volume of liquid cryogen L in the core 30. Method 400 continues with task 418.

In task 418, the controller 312 again measures the pressure and temperature of the core 30 and the flow in the lines 308, 310. Method 400 continues with task 420, a decision task. In task 420, if the temperatures are within predefined limits (task 420: YES), method 400 continues with task 424. If the temperatures are not within the predefined limits (task 420: NO), method 400 continues with task 422 and an alert is established at task 422 before method 400 returns at task 450.

Task 424 is another decision task. In task 424, if the pressure in the core 30 is stable and the calculated mass balance is also stable (task 424: YES), method 400 returns at 450. If any of these things are not stable (task 424: NO), method 400 returns to task 406.

Method 400 presents a relatively simple algorithm for a single cryogenic cell 10: if the pressure of the cryogenic vapor V is too high, increase outflow from the core 30 and adjust the inflow to maintain mass balance. If the pressure of the cryogenic vapor V reaches a low-threshold, reduce the outflow in order to reallocate resources and adjust the inflow to maintain mass balance. In a practical implementation, however, the controller 312 may have many more factors to consider. For example, after determining in task 406 that the pressure in a core 30 is too high, the controller 312 may examine whether there is sufficient capacity to increase the outflow to that core 30. In making that decision, the controller 312 may examine whether all compressors 302 are online, the relative loads on each compressor 312, and whether a sufficient volume of liquid cryogen L is available. This latter issue may be addressed by releasing additional liquid cryogen L from the surge tank 311. If the cryogenic cells 10 have pressure-relief valves 182 installed, the controller 312 may be programmed to maintain a lower pressure in the core 30 than the pressure at which the pressure-relief valves 182 actuate.

In many embodiments, multiple cryogenic cells 10 will receive equal amounts of fluid to process in parallel. In those embodiments, there is usually no need to prioritize one cryogenic cell 10 over another. However, even in those situations, the kind of resource allocation and shifting can be used to address a cryogenic cell 10 that is malfunctioning or underperforming (e.g., after task 422 of method 400 and before method 400 returns at task 450). In an extreme case, the controller 312 may simply close valves that lead to a particular cryogenic cell 10, essentially turning it off.

There may also be embodiments in which cryogenic cells 10 receive fluid in series. This may be the case, for example, if it is necessary to pre-cool an incoming fluid to a particular initial temperature in one cryogenic cell 10 before taking that fluid to a second, lower temperature in another cryogenic cell 10. If the cryogenic cells 10 are arranged in a series configuration (or some kind of mixed series-parallel configuration), then it may be desirable to prioritize the needs of certain cryogenic cells 10 or sets of cryogenic cells 10.

The above description focuses on the controller 312 having control over mass flow into and out of the core 30 of a cryogenic cell 10. However, the controller 312 may also have control over valves (not shown in the figures) that lead to the ports 42, 44 for the set of coils 40 within the pressurizable space 34. In other words, the controller 312 may also have control over the manner in which the fluid to be processed enters the set of coils 40 within the pressurizable space 34. In that case, the controller 312 may respond to an overload or a malfunction by shutting off the flow of fluid to be processed into the set of coils 40.

In managing the work of the cryogenic cells 10, the description above focuses on the use of pneumatic valves. In fact, in a manifold 304 like that shown in FIG. 11, the valves may also be pneumatic. This focus on pneumatic valves is for several reasons. First, in a system that uses cryogenic cells 10, gas to drive pneumatic valves is likely to be readily available. For example, the pneumatic valves may be driven by nitrogen gas. Second, in many embodiments and installations, although certainly not all, cryogenic cells 10 will be used to process flammable gas feedstocks, e.g., those including methane and longer-chain hydrocarbons. In those circumstances, it is helpful to avoid exposing those feedstocks to anything that could cause a spark, and thus, cause a fire. Electrically-operated valves, like those operated by relays and solenoids, have the potential to spark and arc; pneumatic valves do not.

As those of skill in the art will understand, while it may be helpful to eschew anything that could spark or arc in systems according to this description, this is not an absolute rule. For example, if one is processing air to remove moisture, as is suggested by international publication WO2023/004433, sparks may be less of a concern and solenoid- or relay-actuated valves may be used. This is generally true if the gas or fluid being processed is not flammable.

In the description above, all of the cryogenic cells are assumed to be of the same type. However, with no cold head, it is much easier to change the size and proportions of cryogenic cells. As one example, given the dimensions set forth above, a cryogenic cell 10 may have an interior volume of about 400 L, of which the core 30 has a volume of about 200 L. In other words, in the cryogenic cell 10 described above, about 50% of the interior volume of the cryogenic cell 10 is consumed by the core 30.

Figure 13:
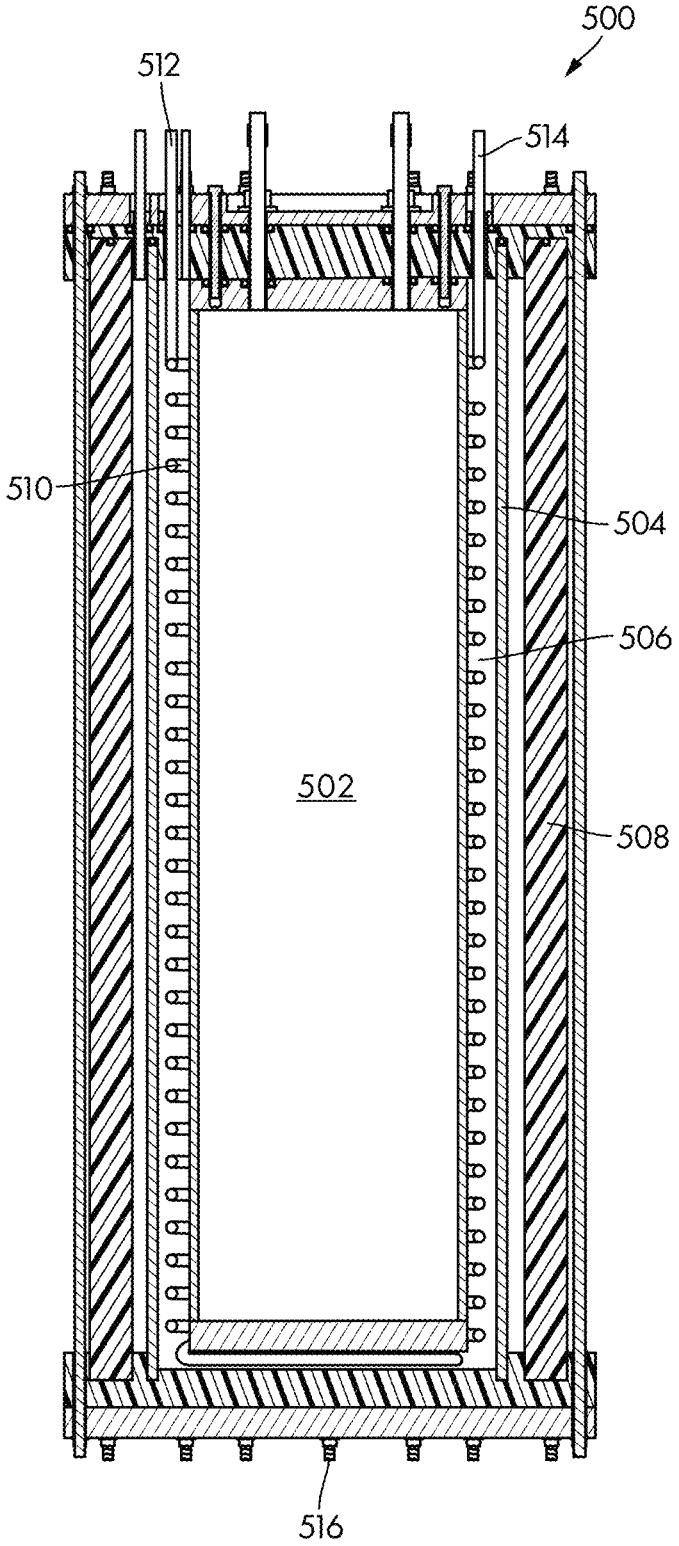
FIGS. 13-14 are cross-sectional views of cryogenic cells according to other embodiments, with different core and cell proportions and volumes.

FIG. 13 is a cross-sectional view of a cryogenic cell, generally indicated at 500, according to another embodiment. The cryogenic cell 500 has generally the same components as the cryogenic cell 10 described above; therefore, parts not described here may be assumed to be the same, or about the same, as those described above. As with the cryogenic cell 10, the cryogenic cell 500 has an inner core 502 a mid-wall 504 that defines a pressurizable space 506 between the core 502 and the mid-wall 504, and an outer sidewall 508. A set of coils 510 is positioned in the pressurizable space 506, essentially coiled around, but at a distance from, the core 502. The set of coils 510 has exterior inlet and outlet ports 512, 514.

The cryogenic cell 500 is taller than the cryogenic cell 10, but as can be seen in FIG. 13, the differences between the two cryogenic cells 10, 500 are more distinct along the interior. In particular, while the core 502 extends for most of the height of the cryogenic cell 500, terminating with just enough space between the core 502 and the bottom 516 for a coil of the set of coils 510 to extend beneath it, the core 502 has a significantly smaller radius than the core 30 described above and shown in other figures. This leaves a larger pressurizable space 506 and more space between the set of coils 510 and the core 502. The core 502 may consume, e.g., 25% of the internal volume of the cryogenic cell 500.

Figure 14:
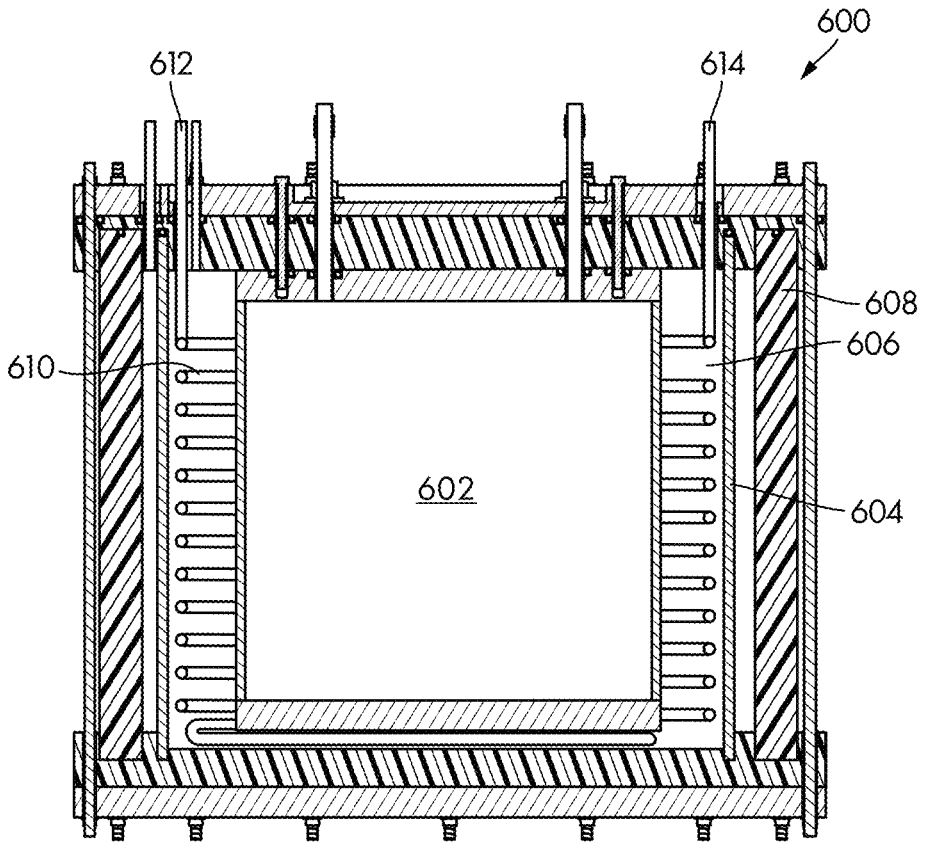

FIG. 14 is a cross-sectional view of a cryogenic cell 600. The cryogenic cell 600 has generally the same components as the cryogenic cell 10 described above; therefore, parts not described here may be assumed to be the same, or about the same, as those described above. As with the cryogenic cell 10, the cryogenic cell 600 has an inner core 602 a mid-wall 604 that defines a pressurizable space 606 between the core 602 and the mid-wall 604, and an outer sidewall 608. A set of coils 610 is positioned in the pressurizable space 606, essentially coiled around, but at a distance from, the core 602. The set of coils 610 has exterior inlet and outlet ports 612, 614.

In general, the cryogenic cell 600 is shorter than the cryogenic cells 10, 500 described above, with a core 602 that consumes somewhat less volume than the core 30 described above, e.g., about 35-40% of the interior volume of the cryogenic cell 600. With no cold head, it becomes much easier to scale the components of cryogenic cells 10, 500, 600. For example, small cryogenic cells with interior volumes of, e.g., 2 L may be constructed. Small-volume cryogenic cells may be particularly useful for small thermal loads, or to provide extensive redundancy in processing larger loads using many cryogenic cells together in parallel.

Generally speaking, this description does not assume that a cryogenic cell 10, 500, 600 will be used for any particular purpose. Rather, the embodiments described here are suitable for a wide range of applications. To that end, the fluid flowing through the set of coils 40, 510, 610 may be a liquid or a gas, and the cryogen within the core 30, 502, 602 may be any cryogen. The pressurizable space 34, 506, 606 may be pressurized to any pressure ranging from near-vacuum to about 1000 psi (about 7 MPa). The effect on the fluid flowing through the coils 30, 510, 610 will depend on the particular temperature and pressure conditions in the pressurizable space 34, 506, 606 around the coils 30—one of the reasons why the cryogenic cells 10, 500, 600 are so versatile.

This description uses the term "about." When that term is used to modify a numerical value or range, it means that that numerical value or range can vary so long as the described end result does not. If it cannot be determined what range would not cause the described end result to vary, the term should be interpreted as meaning ±10%.

While the invention has been described with respect to certain embodiments, the description is intended to be exemplary, rather than limiting. Modifications and changes may be made within the scope of the invention, which is defined by the appended claims.

What is claimed is:

1. A cryogenic cell, comprising:

a core adapted to contain a cryogen, the core having one or more ports to an outside of the cryogenic cell that allow the cryogen to circulate into and out of the core;

a mid-wall disposed around the core and spaced from the core, the mid-wall defining, in part, a space in selective, partial thermal communication with the core, the space being at least substantially airtight and adapted to be filled or evacuated with a compressible fluid that (1) increases or decreases thermal communication with the core in accordance with a pressure of the compressible fluid within the space, and (2) places contents of the space under the pressure of the compressible fluid; and a conduit positioned within the space such that the conduit does not make physical contact with the core, the conduit being connected with inlet and outlet ports in the cryogenic cell;

wherein the cryogenic cell does not include a cold head within the core.

2. The cryogenic cell of claim 1, wherein the cryogenic cell further comprises:

an outer sidewall disposed around the mid-wall;

a top; and a bottom;

wherein the outer sidewall, the top, and the bottom are each made of a thermally insulative material.

3. The cryogenic cell of claim 2, wherein the outer sidewall is made of a different thermally insulative material than the thermally insulative material of the top and the bottom.

4. The cryogenic cell of claim 2, wherein the conduit comprises a set of coils arranged around the core.

5. The cryogenic cell of claim 2, wherein the space comprises at least one pressurization port that communicates with the outside of the cryogenic cell.

6. The cryogenic cell of claim 1, wherein the one or more ports in the core comprise a cryogen inlet port and a cryogen outlet port.

7. A system, comprising:

a cryogenic cell, including a core adapted to contain a cryogen, the core having a cryogen inlet port and a cryogen outlet port that communicate with an outside of the cryogenic cell, a mid-wall disposed around the core and spaced from the core, the mid-wall defining, in part, a space in selective, partial thermal communication with the core, the space being at least substantially airtight and adapted to be filled or evacuated with a compressible fluid that (1) increases or decreases thermal communication with the core in accordance with a pressure of the compressible fluid within the space, and (2) places contents of the space under the pressure of the compressible fluid, and a conduit positioned within the space such that the conduit does not make physical contact with the core, the conduit being connected with inlet and outlet ports in the cryogenic cell; and a cryogenic compressor connected to the cryogen inlet port and the cryogen outlet port, the cryogenic compressor arranged and adapted to remove cryogen vapor resulting from heat exchange between the core and the space from the core through the cryogen outlet port, compress the cryogen vapor into liquid cryogen, and return the liquid cryogen to the core through the cryogen inlet port.

8. The system of claim 7, wherein the cryogenic compressor comprises two or more cryogenic compressors.

9. The system of claim 8, wherein the two or more cryogenic compressors are connected in parallel to the cryogenic cell.

10. The system of claim 8, wherein the two or more cryogenic compressors are connected in series to the cryogenic cell.

11. The system of claim 10, wherein bypasses are installed such that one of the two or more series-connected cryogenic compressors can be active at any one time.

12. The system of claim 10, wherein the two or more series-connected cryogenic compressors are different, such that they effect a first-stage compression and a second-stage compression.

13. The system of claim 7, wherein the cryogenic cell comprises two or more cryogenic cells.

14. The system of claim 13, wherein the cryogenic compressor comprises two or more cryogenic compressors.

15. The system of claim 14, wherein the two or more cryogenic compressors are connected in parallel to the two or more cryogenic cells.

16. The system of claim 14, wherein the two or more cryogenic compressors are connected in series to the two or more cryogenic cells.

17. The system of claim 16, wherein bypasses are installed such that one of the two or more series-connected cryogenic compressors can be active at any one time.

18. The system of claim 16, wherein the two or more series-connected cryogenic compressors are different, such that they effect a first-stage compression and a second-stage compression.

19. A system, comprising:

a manifold;

a cryogenic cell, including a core adapted to contain a cryogen, the core having a cryogen inlet port and a cryogen outlet port that communicate with the manifold, a mid-wall disposed around the core and spaced from the core, the mid-wall defining, in part, a space in selective, partial thermal communication with the core, the space being at least substantially airtight and adapted to be filled or evacuated with a compressible fluid that (1) increases or decreases thermal communication with the core in accordance with a pressure of the compressible fluid within the space, and (2) places contents of the space under the pressure of the compressible fluid, and a conduit positioned within the space such that the conduit does not make physical contact with the core, the conduit being connected with inlet and outlet ports in the cryogenic cell; and two or more cryogenic compressors connected to the manifold, such that the two or more cryogenic compressors are selectively coupled to the core of the cryogenic cell through the manifold to remove cryogen vapor resulting from heat exchange between the core and the space from the core through the cryogen outlet port, compress the cryogen vapor into liquid cryogen, and return the liquid cryogen to the core through the cryogen inlet port.

20. The system of claim 19, wherein the cryogenic cell comprises a plurality of cryogenic cells each of which having the cryogen inlet port and the cryogen outlet port in communication with the manifold.

21. The system of claim 19, further comprising a controller connected to and controlling the manifold and the two or more cryogenic compressors, the controller controlling the manifold to independently control the rate at which the cryogen is removed from the cores of the plurality of cryogenic cells in accordance with the thermal load on each of the plurality of cryogenic cells.

* * * * *